US008820523B1

(12) United States Patent
Breza et al.

(10) Patent No.: US 8,820,523 B1
(45) Date of Patent: Sep. 2, 2014

(54) SPORTS EQUIPMENT BAG

(71) Applicants: Doug J. Breza, Bullhead City, AZ (US); Dawn Donegan, Bullhead City, AZ (US)

(72) Inventors: Doug J. Breza, Bullhead City, AZ (US); Dawn Donegan, Bullhead City, AZ (US)

( * ) Notice: Subject to any disclaimer, the term of this patent is extended or adjusted under 35 U.S.C. 154(b) by 0 days.

(21) Appl. No.: 14/134,562

(22) Filed: Dec. 19, 2013

Related U.S. Application Data

(60) Provisional application No. 61/842,118, filed on Jul. 2, 2013.

(51) Int. Cl.
*B65D 85/20* (2006.01)
*A63B 71/00* (2006.01)

(52) U.S. Cl.
CPC ..... *A63B 71/0045* (2013.01)
USPC ..... 206/315.1; 206/524.3; 219/386; 126/681; 190/124

(58) Field of Classification Search
USPC ..... 206/315.1, 315.9, 315.2, 315.3, 524.1, 206/524.3; 190/1, 124, 109, 110; 224/600, 224/605, 607, 268, 269, 919; 219/385, 386; 126/681
See application file for complete search history.

(56) References Cited

U.S. PATENT DOCUMENTS 4,916,290 A * 4/1990 Hawkins ..... 219/385
4,934,584 A * 6/1990 Wyant ..... 229/67.1
5,687,705 A * 11/1997 Blair ..... 126/229
5,704,475 A * 1/1998 Jack ..... 206/315.4
5,860,415 A 1/1999 Waters
6,196,217 B1 3/2001 Smith
6,229,132 B1 * 5/2001 Knetter ..... 219/759
6,247,469 B1 * 6/2001 Guard ..... 126/263.01
6,736,302 B1 * 5/2004 Brownlee ..... 224/607
6,870,089 B1 * 3/2005 Gray ..... 136/251
7,325,679 B2 2/2008 Severa et al.
8,556,337 B1 * 10/2013 Cornitius-Cary ..... 297/180.11
8,567,459 B2 * 10/2013 Kitchen ..... 150/147
2003/0042157 A1 * 3/2003 Mays ..... 206/315.1
2006/0207898 A1 9/2006 Cheng
2006/0243365 A1 * 11/2006 Chiapuzio et al. ..... 150/154
2007/0056998 A1 * 3/2007 Olson ..... 224/148.2
2009/0027792 A1 1/2009 Dreyer et al.
2012/0210638 A1 8/2012 Townsley

FOREIGN PATENT DOCUMENTS

WO 8607627 A1 12/1986

* cited by examiner

*Primary Examiner* — Jacob K Ackun
(74) *Attorney, Agent, or Firm* — Robert C. Montgomery; Montgomery Patent & Design

(57) ABSTRACT

A sports equipment bag assembly having a removable bag enclosure for heating bats using sunlight. The removable bag enclosure has a transparent outer panel and a solar reflective inner panel. The reflective surface both insulates and reflects the solar light to heat the bats. The removable bag enclosure is removably fastened to a larger bag assembly by a fastener such as a zipper. The removable bag enclosure and the larger bag assembly have hooks that enable them to be hung upon a fence or similar structure. The sports equipment bag assembly further provides a shoulder strap to facilitate carrying.

20 Claims, 3 Drawing Sheets

SPORTS EQUIPMENT BAG

RELATED APPLICATIONS

The present invention was first described in and claims the benefit of U.S. Provisional Application No. 61/842,118 filed on Jul. 2, 2013, the entire disclosure of which is incorporated herein by reference.

FIELD OF THE INVENTION

The present invention generally relates to sports equipment. More specifically, the present invention describes a solar energy warmed sports equipment bag assembly.

BACKGROUND OF THE INVENTION

Baseball is, and for well over a hundred years, has been among the most popular game in the United States. The exhilaration of stepping onto a baseball field with your teammates knowing that only one (1) team will come out a winner can last a lifetime.

Baseball is a game that depends not only on physical strength but also on speed, batting skills, ball handling, teamwork, thought, timing and execution. As such, baseball is a game that many people cannot resist playing and/or watching.

One (1) important piece of baseball equipment is the baseball bat. Since baseball is played throughout the United States starting in early spring it is not always played in warm weather. Many games and practices take place in cool spring and cool fall seasons. As many players both young and old have discovered for themselves, there are issues when striking a baseball with a cold baseball bat. Cold bats are much more susceptible to breaking and other forms of damage. Batters may experience a painful sting in their hands when striking a ball with a cold baseball bat. Finally, it is readily apparent that a ball struck with a cold baseball bat simply does not fly as fast or as far as one similarly struck with a warm baseball bat.

Accordingly, there exists a need for a device that warms baseball bats. Such a device should hold at least two (2) baseball bats. Preferably such a device would not require batteries or electric power, would be easily handled, and could be made available at low cost. Such a device would help prevent damage to baseball bats while reducing the incidence of stinging hands. Beneficially, such a device would also enable hitting balls faster and further. Such a device should be rugged and useful for both baseball and softball bats as well as other baseball related items such as gloves and balls. Ideally the handles of the baseball bats could be stored such that they remain cool to the touch.

SUMMARY OF THE INVENTION

The principles of the present invention provide for a sports equipment bag assembly that uses solar energy to heat the bats. The sports equipment bag assembly includes a large bag assembly and a small bag that traps solar energy using a light transmissive front panel beneficially made of a heavy clear vinyl and a solar energy reflective back panel that is beneficially made from an insulated, silver colored, thermally reflective material that reflects the suds rays back into the enclosure. The large bag assembly includes a large zippered opening while the small bag has attachment hooks.

The sports equipment bag assembly may be equipped with straps and other aids such as pockets, zippers, and the like to facilitate use. The small bag is preferably dimensioned such that only the bodies of the bats are enclosed while the handles remain outside. This allows the body of the bats to warm up while the handles remain cool. When warmed, the baseball bats allow for easier and more comfortable hitting as well as further distances and reduced damage.

A bag enclosure that is in accord with the present invention includes a transparent front panel that is attached to a solar reflective rear panel along two (2) sides and bottom so as to form an open top enclosure. The bag enclosure further includes an inverted "U"-shaped first reinforcing edging running along the outer edge of the top and an inverted "U"-shaped second reinforcing edging running along the inner edge of the top. An inverted "J"-shaped metal hook is attached to the rear panel though the second reinforcing edging by a fastener. The bag enclosure is deep enough to contain a thick body portion of a bat but not deep enough to contain the full length of a bat.

The inverted "U"-shape of the second reinforcing edging beneficially has legs longer than the legs of the inverted "U"-shape of the first reinforcing edging. In practice the first reinforcing edging is sewn to the top. The front panel beneficially comprises a clear heavy-mil vinyl. Preferably the rear panel includes a textile rear panel and an outwardly-facing reflective layer. Beneficially the reflective layer is a metalized polyethylene sheet material.

An equipment bag assembly that is in accord with the present invention includes a large bag assembly having a large enclosure and a small bag. The small bag includes a transparent front panel that is attached to a solar reflective rear panel along two (2) sides and bottom so as to form an open top small enclosure. The small bag further includes an inverted "U"-shaped first reinforcing edging running along the outer edge of the top and an inverted "U"-shaped second reinforcing edging running along the inner edge of the top. An inverted "J"-shaped metal hook is attached to the rear panel through the second reinforcing edging by a first fastener. The small bag is deep enough to contain the thick body portion of a bat but not deep enough to contain the full length of a bat. In addition, a first bag attachment feature is attached to the large enclosure and a second bag attachment feature is attached to the small bag. The first bag attachment feature and the second bag attachment feature attach the small bag to the large bag assembly.

In the equipment bag assembly the inverted "U"-shape of the second reinforcing edging beneficially has legs longer than the legs of the inverted "U"-shape of the first reinforcing edging. In practice the first reinforcing edging is sewn to the top. The front panel beneficially comprises a clear heavy-mil vinyl. Preferably the rear panel includes a textile rear panel and an outwardly-facing reflective layer. Beneficially the reflective layer is a metalized polyethylene sheet material.

In the equipment bag assembly the large bag assembly may include a second inverted "J"-shaped metal hook. It may also include an exterior pouch, preferably having a flap to close the pouch. The large bag assembly may include a first strap that is attached by a first strap fastener and a second strap that is attached by a second strap fastener. A detachable connector may be included for connecting the first strap to the second strap. Helpfully, the first strap includes a length adjustment. The large bag assembly may also include a zipper for closing the large enclosure.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
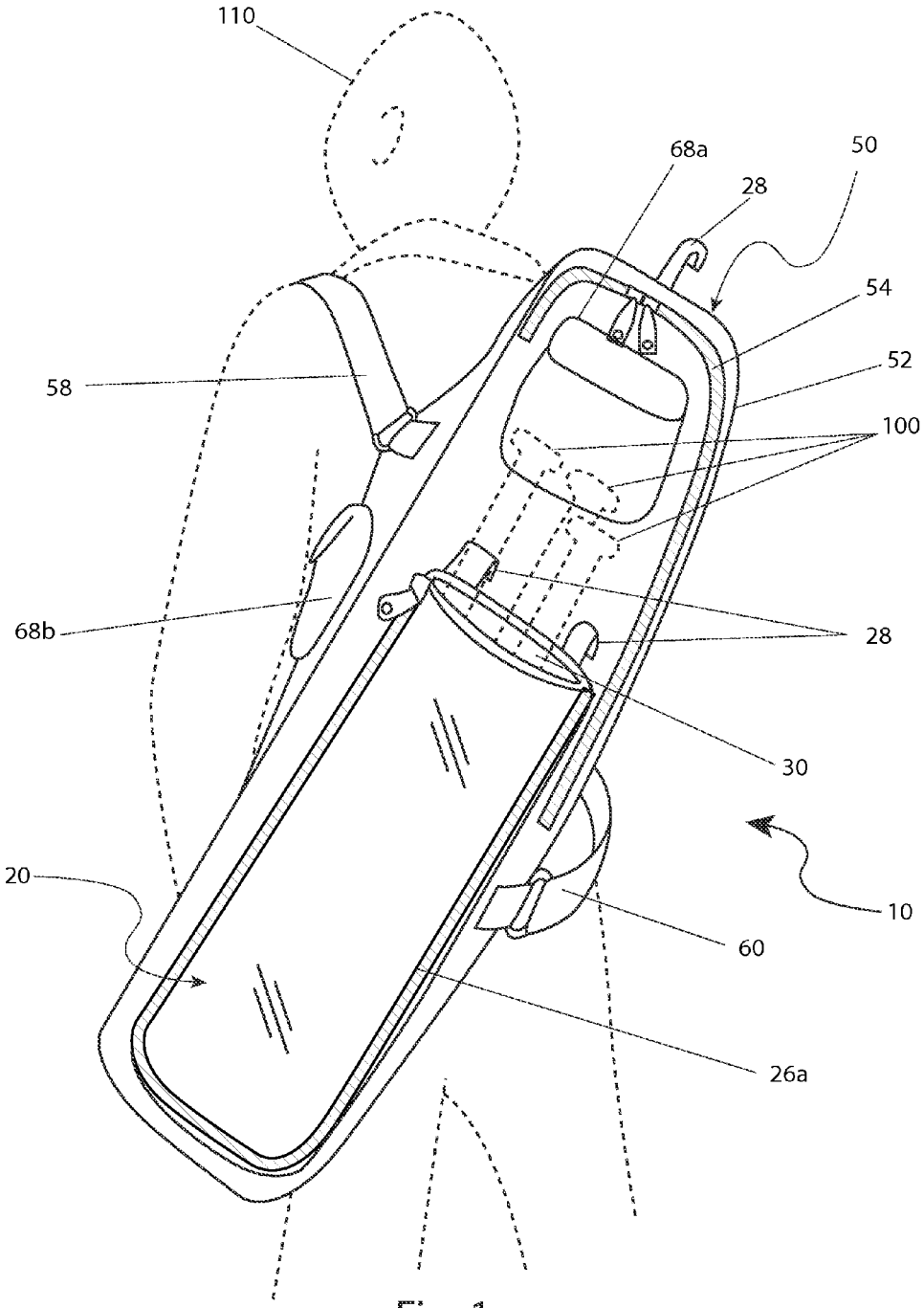
FIG. 1 is an environmental view of a sports equipment bag assembly 10 that is in accord with a preferred embodiment of the present invention.

10 sports equipment bag assembly
20 small bag
22 front panel
24 rear panel
25 reflective layer
26*a* first fastener
26*b* second fastener
28 hook
30 top opening
32*a* first reinforcing edging
32*b* second reinforcing edging
50 large bag assembly
52 large bag enclosure
54 third fastener
56 puller
58 upper strap
60 lower strap
62*a* first buckle
62*b* second buckle
64 ring
66*a* first strap attachment
66*b* second strap attachment
68*a* first pocket
68*b* second pocket
80 fourth fastener
100 bat
110 user

DETAILED DESCRIPTION OF THE PREFERRED EMBODIMENT

Figure 2:
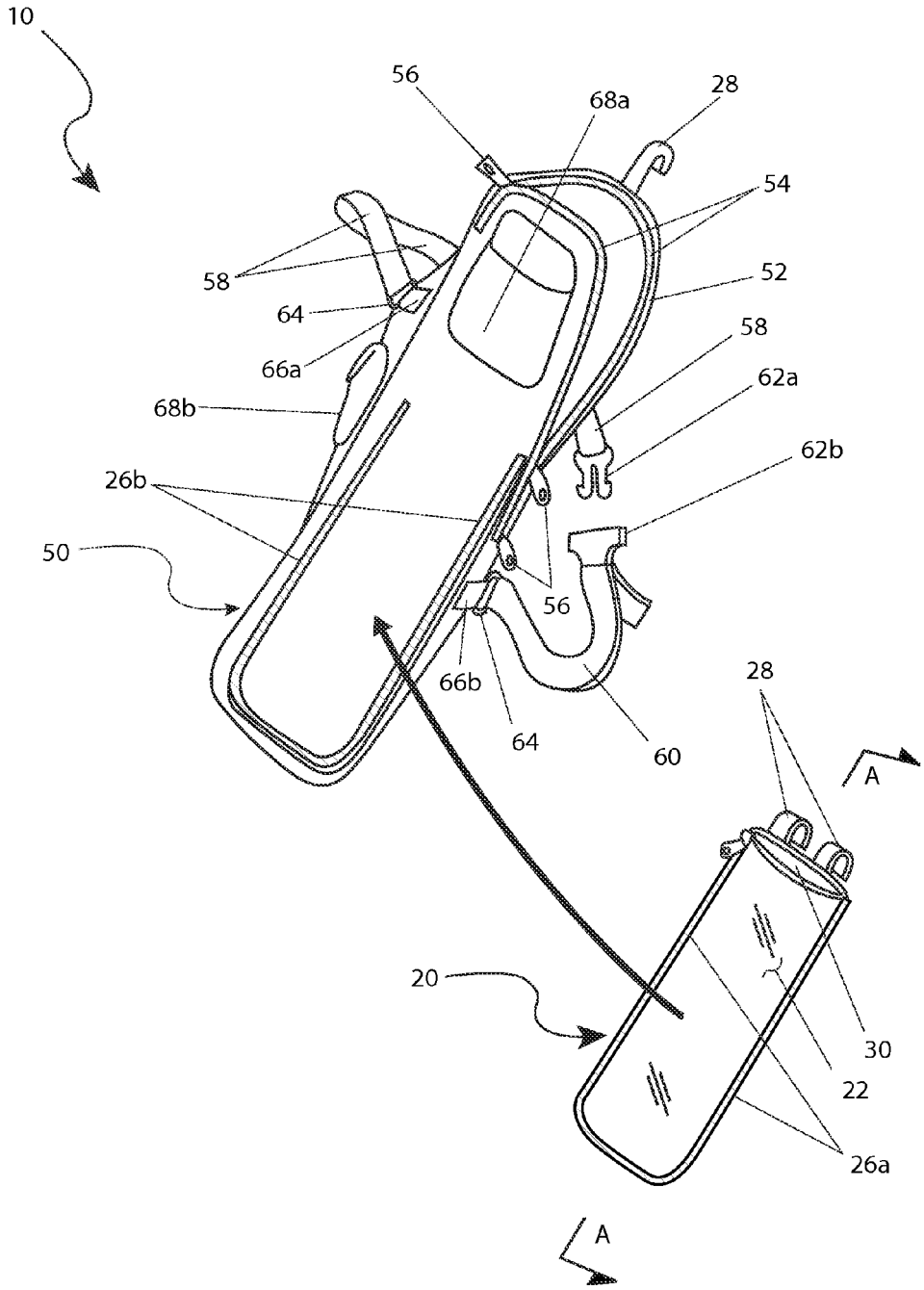
FIG. 2 is an exploded view of the sports equipment bag 10 shown in FIG. 1; and, FIG. 3 is a sectional view of a small bag 20 taken along section line A-A of FIG. 2.
Figure 3:
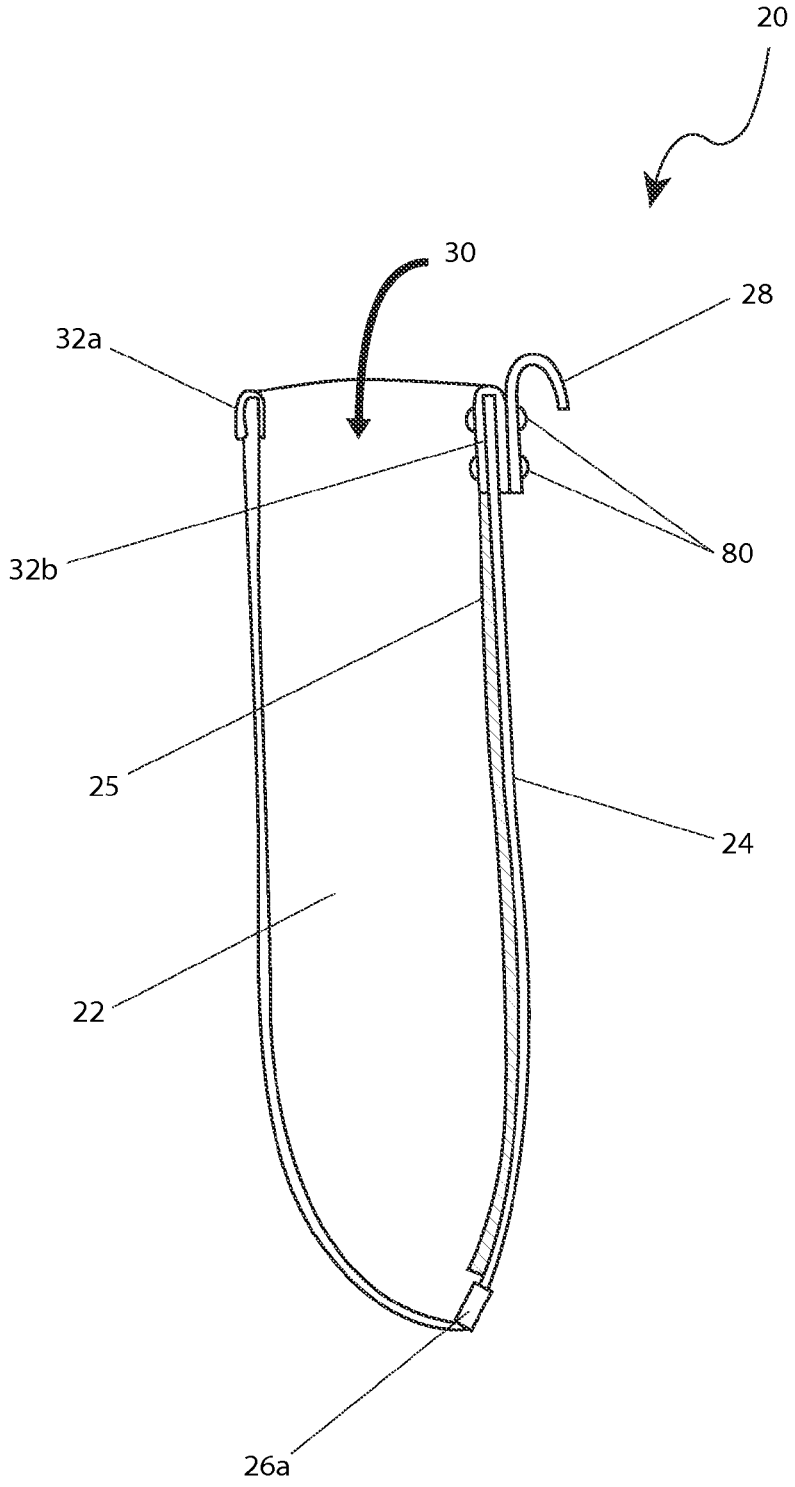

In accordance with the invention, the best mode is presented in terms of the described embodiments, herein depicted within FIGS. 1 through 3. However, the disclosure is not limited to the described embodiments and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only certain configurations have been shown and described for purposes of clarity and disclosure and not by way of limitation of scope.

It can be appreciated that, although such terms as first, second, etc. may be used herein to describe various elements, these elements should not be limited by these terms. These terms are only used to distinguish one (1) element from another element. Thus, a first element discussed below could be termed a second element without departing from the scope of the present invention. In addition, as used herein, the singular forms "a", "an" and "the" are intended to include the plural forms as well, unless the context clearly indicates otherwise. It also will be understood that, as used herein, the term "comprising" or "comprises" is open-ended, and includes one (1) or more stated elements, steps or functions without precluding one (1) or more unstated elements, steps or functions. Relative terms such as "front" or "rear" or "left" or "right" or "top" or "bottom" or "below" or "above" or "upper" or "lower" or "horizontal" or "vertical" may be used herein to describe a relationship of one (1) element, feature or region to another element, feature or region as illustrated in the figures. It should be understood that these terms are intended to encompass different orientations of the device in addition to the orientation depicted in the figures. It should also be understood that when an element is referred to as being "connected" to another element, it can be directly connected to the other element or intervening elements may be present. In contrast, when an element is referred to as being "directly connected" to another element, there are no intervening elements present. It should also be understood that the sizes and relative orientations of the illustrated elements are not shown to scale, and in some instances they have been exaggerated for purposes of explanation.

Referring now to FIG. 1, the present invention describes a sports equipment bag assembly 10 that enables softball and baseball bats 100 and other associated items such as baseball gloves to be warmed by the sun. The sports equipment bag assembly 10 includes a small bag 20 (best shown in FIG. 3) that is attachable to a large bag assembly 50 via a first fastener 26*a* that mates with a second fastener 26*b*. The first fastener 26*a* and the second fastener 26*b* may be a zipper (preferred), or they may be hook-and-loop fasteners or equivalent joiners. The small bag 20 allows contained bats 100 to warm when exposed to the sun. The small bag 20 is detachable from the large bag assembly 50 to enable separate use and the small bag can be mounted to a fence or other structure using integral hooks 28.

Referring now to FIGS. 1-3 as required, the small bag 20 forms a rather tall narrow pouch having a clear front panel 22 and a rear panel 24 that is comprised of a textile layer that is covered by an interior reflective layer 25. The front panel 22 and the rear panel 24 are similarly shaped and are sewn or equivalently joined together along the side and bottom edges. However, the pouch's front panel 22 and rear panel 24 form a top opening 30.

The small bag 20 is configured to be selectively connected to the large bag assembly 50. As previously described, the attachment is via the first fastener 26*a* and the second fastener 26*b*. The first fastener 26*a* and the second fastener 26*b* are preferably respectively sewn, or equivalently affixed to the small bag 20 and to the large bag assembly 50. The first fastener 26*a* and the second fastener 26*b* are preferably heavy-duty zippers.

Referring now primarily to FIG. 2, the large bag assembly 50 has a large, vertically elongated and generally rectangular large bag enclosure 52. That large bag enclosure 52 is envisioned as being made of a heavy duty textile material such as, but not limited to: canvas, another heavy-duty fabric, or the like. The large bag enclosure 52 provides sufficient interior space to hold several softball and/or baseball bats 100 as well as various related equipment such as uniforms, shoes, baseball gloves, and the like. The large bag assembly 50 also includes a third fastener 54 that extends along one side of the large bag enclosure 52, over an upper end of the large bag enclosure 52, and down an opposing side of the large bag enclosure 52. The third fastener 54 is preferably a heavy-duty zipper with dual pullers 56. The third fastener 54 provides easy access to the interior of the large bag enclosure 52 and to the items placed therein while also enabling retention of those items within the large bag enclosure 52.

The large bag assembly 50 also includes a two-part shoulder strap that is comprised of an upper strap 58 and a lower strap 60. One (1) end of the upper strap 58 is attached to the large bag assembly 50 by a stitched first strap attachment 66*a*. The other end of the upper strap 58 has a fixed first buckle 62*a*. One (1) end of the lower strap 60 is attached to the large bag assembly 50 by a stitched second strap attachment 66*b*. The lower strap 60 has an adjustable second buckle 62*b* that mates with the first buckle 62*a*. The position of the second buckle 62*b* can be adjusted along the length of the lower strap 60. Further adjustment of the length of the two-part shoulder strap is achieved by strap rings 64 that are located both on the upper strap 58 and on the lower strap 60.

The upper strap 58 and the lower strap 60 enable carrying the sports equipment bag assembly 10 on a user's shoulder or by hand. Preferably, the upper strap 58 and the lower strap 60 are long enough that when connected together by the first buckle 62*a* and second buckle 62*b* the resulting two-part shoulder strap can extend over a user's 110 shoulder and run diagonally across the user's chest and back. The lengths of the upper strap 58 and lower strap 60 can be adjusted to fit different size users. Ideally, the first buckle 62*a* and the second buckle 62*b* are envisioned as being a two-part quick release style buckle.

Referring to either FIG. 1 or FIG. 2, the large bag assembly 50 includes a front first pocket 68*a* and a side second pocket 68*b*. The first pocket 68*a* and the second pocket 68*b* are preferably sewn to the exterior of the large bag assembly 50 and both include flaps. The first pocket 68*a* and the second pocket 68*b* enable stowing and carrying smaller items. While only two (2) pockets (the first pocket 68*a* and the second pocket 68*b*) are shown it should be understood that more or even fewer pockets may be included.

FIG. 3 presents a sectional view of the small bag 20 of the sports equipment bag assembly 10 taken along section line A-A of FIG. 2. The small bag 20 uses materials and construction that enable solar energy to heat bats 100 (see FIG. 1) and other items contained therein. The small bag 20 forms a pouch using a clear heavy-mil vinyl front panel 22 and a textile rear panel 24. The rear panel 24 has an adhesively bonded outwardly-facing reflective layer 25. The reflective layer 25 is envisioned as being made of an insulated, silver colored thermally-reflective material. Such a design accepts solar energy and reflects associated heat energy back onto the small bag 20 to warm the enclosed bats 100 (see FIG. 1). The reflective layer 25 is beneficially comprised of a metalized polyethylene sheet material identical or similar to other commonly used reflective materials.

The small bag 20 also includes a pair of inverted "J"-shaped metal hooks 28 that are affixed to its upper rear edge by fourth fasteners 80 such as rivets or the like. The hooks 28 allow the small bag 20 to be attached to and hung from various structures such as chain-link fences, railings, dugout walls, and the like. In addition, as shown in FIG. 2, the large bag assembly 50 also includes an upper hook 28 that enables the complete sports equipment bag assembly 10 to be hung from such structures.

The small bag 20 has an open top pouch that is reinforced by a first reinforcing edging 32*a* that runs along the outer edge and a second reinforcing edging 32*b* that runs along the inner edge. The first reinforcing edging 32*a* and the second reinforcing edging 32*b* are both inverted "U"-shapes made of plastic, leather, or another other durable yet semi-rigid material. They are sewn or otherwise affixed to the top of the small bag 20 so as to prevent tearing and wear. In practice the second reinforcing edging 32*b* is longer than the first reinforcing edging 32*a* to provide a durable support for the hooks 28 and the fourth fasteners 80.

The small bag 20 is only deep enough to contain the thick body portions of bats 100 (see FIG. 1). This allows heating the thick body portions while the handle remains cool and outside the small bag 20. When exposed to solar energy the sports equipment bag assembly 10 can rapidly warm the contained bats 100 yet the handles remain cool.

It is envisioned that other styles and configurations of the present invention can be easily incorporated into the teachings of the present invention, and only one particular configuration is shown and described that is for purposes of clarity and disclosure and not by way of limitation of scope.

The preferred embodiment of the present invention can be used in a simple and effortless manner with little or no training. After initial purchase or acquisition of the sports equipment bag assembly 10 it would be configured and using as indicated in FIG. 1.

The method of configuring and using the sports equipment bag assembly 10 is performed by: procuring a model of the sports equipment bag assembly 10 having a desired overall size and desired number and arrangement of the first pocket 68*a* and the second pocket 68*b*; attaching the empty small bag 20 to the large bag assembly 50 by engaging and attaching the first fastener 26*a* and the second fastener 26*b* using a zipper puller 56; loading a desired number of bats 100 and related equipment such as uniforms, shoes, baseball gloves, and the like into the large bag assembly 50; adjusting a combined length of the upper strap 58 and lower strap 60 using the first buckle 62*a* and the second buckle 62*b*; extending and attaching the upper strap 58 and lower strap 60 across a user's chest area by engaging the first buckle 62*a* and the second buckle 62*b*; transporting the sports equipment bag assembly 10 and contents to a desired location such as a baseball diamond; removing the small bag 20 from the large bag assembly 50 by disengaging the first fastener 26*a* and the second fastener 26*b*; hanging the sports equipment bag assembly 10 by the hooks 28 upon a structure such that the small bag 20 is exposed to sunlight; placing a desired number of bats 100 into the small bag 20; allowing the clear front panel 22 and reflective surface 25 to warm the bats 100; selecting and using a bat 100 to strike a softball or baseball in a conventional manner; and, benefiting from improved hitting performance of a bat 100, which has been heated by the sports equipment bag.

It is also envisioned that the upper strap 58 and the lower strap 60 or the upper hook 29 of large bag assembly 50 may be used to attach and support the large bag assembly 50 from a structure such as a batting cage, or the like, thereby providing convenient access to the contained equipment.

When warmed by the sports equipment bag assembly 10 a warmed bat 100 will allow for easier and more comfortable hitting of a baseball as well resulting in further hitting distances. Warming a bat 100 may reduce bat damage and prolong the life of the bat 100.

The foregoing embodiments of the disclosed golf club training aid have been presented for purposes of illustration and description. They are not intended to be exhaustive or to limit the invention and method of use to the precise forms disclosed. It can be appreciated by one skilled in the art that other styles, configurations, and modifications of the invention can be incorporated into the teachings of the present disclosure upon reading the specification and that the embodiments shown and described are for the purposes of clarity and disclosure and to limit the scope. The embodiments have been chosen and described in order to best explain the principles and practical application in accordance with the invention to enable those skilled in the art to best utilize the various embodiments with expected modifications as are suited to the particular use contemplated. The present application includes such modifications and is limited only by the scope of the claims.

The invention claimed is:

1. A bag for warming bats, comprising:

a transparent front panel attached to a solar reflective rear panel along two sides and bottom forming an open top pouch;

an inverted "U"-shape first reinforcing edging running along the outer edge of said top;

an inverted "U"-shape second reinforcing edging running along the inner edge of said top;

an inverted "J"-shaped metal hook; and, a fastener attaching said metal hook to said rear panel though said second reinforcing edging;

wherein said bag is deep enough to contain a thick body portion of a bat; and, wherein said bag is not deep enough to contain the full length of a bat.

2. The bag enclosure according to claim 1, wherein said inverted "U"-shape of said second reinforcing edging has legs longer than the legs of said inverted "U"-shape of said first reinforcing edging.

3. The bag according to claim 1, wherein said first reinforcing edging is sewn to said top.

4. The bag according to claim 1, wherein said front panel comprises a clear heavy-mil vinyl.

5. The bag according to claim 1, wherein said rear panel includes a textile rear panel.

6. The bag according to claim 5, wherein said rear panel further includes an outwardly-facing reflective layer.

7. The bag according to claim 6, wherein said reflective layer is a metallized polyethylene sheet material.

8. A sports equipment bag assembly, comprising:

a large bag assembly having a large enclosure;

a small bag having:

a transparent front panel attached to a solar reflective rear panel along two sides and bottom forming an open top pouch;

an inverted "U"-shape first reinforcing edging running along the outer edge of said top;

an inverted "U"-shape second reinforcing edging running along the inner edge of said top;

a first inverted "J"-shaped metal hook; and, a first fastener attaching said metal hook to said rear panel though said second reinforcing edging;

wherein said small bag is deep enough to contain the thick body portion of a bat; and, wherein said small bag is not deep enough to contain the full length of a bat;

a first bag attachment feature attached to said large enclosure;

a second bag attachment feature attached to said small bag;

wherein said first bag attachment feature and said second bag attachment feature attach said small bag to said large bat assembly.

9. The sports equipment bag assembly according to claim 8, wherein said inverted "U"-shape of said second reinforcing edging has legs longer than the legs of said inverted "U"-shape of said first reinforcing edging.

10. The sports equipment bag assembly according to claim 8, wherein said first reinforcing edging is sewn to said top.

11. The sports equipment bag assembly according to claim 8, wherein said front panel comprises a clear heavy-mil vinyl.

12. The sports equipment bag assembly according to claim 8, wherein said rear panel includes a textile rear panel.

13. The sports equipment bag assembly according to claim 12, wherein said rear panel further includes an outwardly-facing reflective layer.

14. The sports equipment bag assembly according to claim 13, wherein said reflective layer is a metallized polyethylene sheet material.

15. The sports equipment bag assembly according to claim 8, wherein said large bag assembly includes a second inverted "J"-shaped metal hook.

16. The sports equipment bag assembly according to claim 8, wherein said large bag assembly includes an exterior pouch.

17. The sports equipment bag assembly according to claim 16, wherein said exterior pouch includes a flap to close said pouch.

18. The sports equipment bag assembly according to claim 8, wherein said large bag assembly includes a first strap attached by a first strap fastener, a second strap attached by a second strap fastener, and a detachable connector for connecting said first strap to said second strap.

19. The sports equipment bag assembly according to claim 18, wherein said first strap includes a length adjustment.

20. The sports equipment bag assembly according to claim 8, wherein said large bag assembly includes a zipper for closing said large enclosure.

* * * * *